US008083698B2

(12) United States Patent
Wu et al.

(10) Patent No.: US 8,083,698 B2
(45) **Date of Patent: *Dec. 27, 2011**

(54) MASSAGE DEVICE WITH A HOIST TRANSMISSION MECHANISM

(75) Inventors: Chichun Wu, Dongguan (CN); Zhao Zhang, Dongguan (CN); Chi-Wu Chiang, Dongguan (CN)

(73) Assignee: Weightec Electronic Technology Co., Ltd., Dongguan, Guangdong Province (CN)

( * ) Notice: Subject to any disclaimer, the term of this patent is extended or adjusted under 35 U.S.C. 154(b) by 756 days.

This patent is subject to a terminal disclaimer.

(21) Appl. No.: 12/170,146

(22) Filed: Jul. 9, 2008

(65) Prior Publication Data

US 2009/0270781 A1 Oct. 29, 2009

Related U.S. Application Data

(63) Continuation-in-part of application No. 12/103,785, filed on Apr. 16, 2008.

(60) Provisional application No. 61/048,688, filed on Apr. 29, 2008.

(30) Foreign Application Priority Data

Jan. 15, 2008 (CN) ..... 2008 2 0091616

(51) Int. Cl.
*A61H 7/00* (2006.01)
*A61H 19/00* (2006.01)

(52) U.S. Cl. ..... 601/98; 601/90

(58) Field of Classification Search ..... 601/49, 601/56–60, 84–87, 90, 91, 93, 94, 97–101, 601/103, 112, 113, 115, 116, 124, 126, 127, 601/133–136

See application file for complete search history.

(56) References Cited

U.S. PATENT DOCUMENTS

| | | | |
|---|---|---|---|
| 5,265,590 | A | 11/1993 | Tagagi |
| 5,460,598 | A | 10/1995 | Yamasaki et al. |
| 6,454,731 | B1 | 9/2002 | Marcantoni |
| D491,375 | S | 6/2004 | Yuyama |
| 6,808,500 | B1 | 10/2004 | Cheng-Yi et al. |
| 6,849,054 | B1 | 2/2005 | Kim |
| 6,890,313 | B2 | 5/2005 | Kim |
| 6,916,300 | B2 | 7/2005 | Hester et al. |
| D517,337 | S | 3/2006 | Mori |
| 7,014,620 | B2 | 3/2006 | Kim |
| 7,018,347 | B2 | 3/2006 | Kim |
| 7,037,279 | B2 | 5/2006 | Kim |
| 7,048,701 | B2 | 5/2006 | Kim |
| 7,052,475 | B2 | 5/2006 | Kim |
| 7,052,476 | B2 | 5/2006 | Kim |
| 7,081,098 | B2 | 7/2006 | Kim |
| 7,081,099 | B1 | 7/2006 | Luo |
| 7,081,100 | B2 | 7/2006 | Kim |
| 7,108,669 | B2 | 9/2006 | Huang |
| 7,108,670 | B2 | 9/2006 | Huang |

(Continued)

*Primary Examiner* — Kristen Matter

(74) *Attorney, Agent, or Firm* — Morris Manning & Martin LLP; Tim Tingkang Xia, Esq.

(57) ABSTRACT

The present invention relates to a massage device. In one embodiment, the massage device includes a massage assembly and a transmission assembly having a hoist transmission mechanism for driving the massage assembly to provide massage effects. The massage assembly includes a pair of massage members. Each massage member has a driving member having an eccentric wheel and an eccentric block, a massage bracket engaged with the driving member and a plurality of massage heads attached to the massage bracket.

19 Claims, 6 Drawing Sheets

U.S. PATENT DOCUMENTS

| | | | | |
|---|---|---|---|---|
| 7,118,541 | B2 | 10/2006 | Kim | |
| 7,120,947 | B1 | 10/2006 | Magallanes | |
| 7,125,389 | B2 | 10/2006 | Sin | |
| 7,128,721 | B2 | 10/2006 | Ferber et al. | |
| D531,424 | S | 11/2006 | Kusachi | |
| 7,160,261 | B1 | 1/2007 | Huang | |
| 7,179,240 | B2 | 2/2007 | Wu | |
| 7,207,957 | B2 | 4/2007 | Szczepanski | |
| 7,264,598 | B2 | 9/2007 | Shin | |
| 7,347,833 | B2 | 3/2008 | Kim | |
| D565,855 | S | 4/2008 | Takahashi et al. | |
| 7,731,672 | B2 * | 6/2010 | Chiang | 601/112 |
| 2004/0243034 | A1 | 12/2004 | Kim | |
| 2005/0049530 | A1 | 3/2005 | Kim | |
| 2005/0049531 | A1 | 3/2005 | Kim | |
| 2005/0256434 | A1 * | 11/2005 | Luo | 601/86 |
| 2007/0208284 | A1 | 9/2007 | Huang | |
| 2008/0048475 | A1 | 2/2008 | Tanizawa et al. | |
| 2008/0051683 | A1 | 2/2008 | Tanizawa | |

* cited by examiner

MASSAGE DEVICE WITH A HOIST TRANSMISSION MECHANISM

CROSS-REFERENCE TO RELATED PATENT APPLICATION

This application is a continuation-in-part of U.S. patent application Ser. No. 12/103,785, filed Apr. 16, 2008, entitled "A Massage Device," by Chi-Wu Chiang, the disclosure for which is incorporated herein by reference in its entirety, which itself claims priority to and the benefit of, pursuant to 35 U.S.C. 119(a), Chinese patent application Serial No. 200820091616.4, filed Jan. 15, 2008, entitled "A Massage Device," by Chi-Wu Chiang, which is incorporated herein by reference in its entirety. This application also claims priority to and the benefit of, pursuant to 35 U.S.C. §119(e), U.S. provisional patent application Ser. No. 61/048,688, filed Apr. 29, 2008, entitled "Massage Device With a Hoist Transmission Mechanism," by Chichun Wu and Zhao Zhang, which is incorporated herein by reference in its entirety.

FIELD OF THE INVENTION

The present invention relates generally to a massage device, and more particularly to a massage device that utilizes a hoist transmission mechanism and a gyro mechanism to provide massaging effects.

BACKGROUND OF THE INVENTION

Simulated massaging or kneading of parts of the body to aid circulation or relax the muscles has gained popularity, particularly, among people who are lack of exercise. The simulated massaging or kneading effects can be achieved electromagnetically and/or mechanically by means of a massage device. For the electromagnetic massaging or kneading, such a massage device is configured to generate a series of electromagnetic pulses, which are regularly directed to parts of interest of the body so as to perform massaging or kneading thereon. However, the massaging or kneading area of the massage device is limited, and the massaging or kneading effects may not be very gentle.

For the mechanical massaging or kneading, the massage device is usually designed to have a plurality of massage nodes and a driving system to drive the plurality of massage nodes to rotate so as to simulate massaging or kneading when applied to parts of interest of the body. Comparing to the electromagnetic massaging, the limitation of the massaging or kneading area is improved for the mechanical massaging. However, mechanical massage devices are relatively complex and costly.

Therefore, a heretofore unaddressed need exists in the art to address the aforementioned deficiencies and inadequacies.

SUMMARY OF THE INVENTION

The present invention, in one aspect, relates to a massage device. In one embodiment, the massage device has a base cover, a carriage, a transmission assembly and a massage assembly.

The base cover has a longitudinal axis and a plurality of guiding rails formed parallel to the longitudinal axis.

The carriage has a chassis member and a shield member placed over the chassis member to form a chamber therebetween. The chassis member has a plurality of grooves formed such that when the carriage is engaged with the base cover, the plurality of guiding rails is received in the plurality of grooves of the chassis member, respectively, and the carriage is longitudinally movable back and forth along the plurality of guiding rails of the base cover.

The transmission assembly is received in the chamber and secured in the carriage. The transmission assembly has a motor having an output shaft, a worm mechanically coupled with the output shaft of the motor, a pair of first worm wheels meshing with the worm, and a pair of second worm wheels each meshing with a corresponding one of the pair of first worm wheels.

The transmission assembly also has a first gear coaxially mounted under one of the pair of second worm wheels, a second gear meshing with the first gear, and a third gear meshing with the second gear.

Furthermore, the transmission assembly has a hoist transmission mechanism. The hoist transmission mechanism has a reel wheel coaxially mounted to the third gear, a pair of pulleys respectively mounted to the first end portion and the second portion of the base cover, and a cable routed over the pair of pulleys and wound on the reel wheel, thereby defining a first distance, L1, between the reel wheel and one of the pair of pulleys, a second distance, L2, between the reel wheel and the other of the pair of pulleys, and a third distance, L3, between the pair of pulleys, such that when the reel wheel rotates, it causes one of the first distance L1 and the second distance L2 to be decreased and the other of the first distance L1 and the second distance L2 to be increased, where $L1+L2=L \geqq L3$.

Under this arrangement, when the motor is activated, it drives the worm to rotate, the rotation of the worm results in, in turn, the rotations of the pair of first worm wheels, the pair of second worm wheels, the first gear, the second gear, the third gear, and the reel wheel, the rotation of the reel wheel causes one of the first distance L1 and the second distance L2 to be decreased and the other of the first distance L1 and the second distance L2 to be increased, thereby moving the carriage 130 along the plurality of the guiding rails of the base cover.

In one embodiment, the massage assembly has a pair of massage members. Each massage member includes a driving member, a massage bracket and a plurality of massage heads. Each of the plurality of massage heads has a mushroom-shape. In one embodiment, each of the plurality of massage heads has a first structure, a mushroom-shape node and a second structure placed between the first structure and the mushroom-shape node.

Additionally, each of the plurality of massage heads comprises an energy source of capable of generating at least one of thermal energy and photonic energy, where the source energy comprises a lamp base mounted to the corresponding one of the plurality of stumps, a PCB board attached to the lamp base, and heating lamps attached onto the PCB board.

In one embodiment, the driving member includes an eccentric wheel and an eccentric block. The eccentric wheel has a first planar surface, a second planar surface tilted to the first planar surface at an angle $\beta$, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion. The first cylindrical portion has a central axis substantially perpendicular to the first planar surface, and a diameter, $d_1$. The second cylindrical portion has a central axis substantially perpendicular to the second planar surface and defining an angle $\alpha$, relative to the central axis of the first cylindrical portion, and a diameter, $d_2$, less than the diameter $d_1$ of the first cylindrical portion. The shaft bore has a central axis that is substantially coincident with the central axis of the first cylindrical portion.

The eccentric block has a first planar surface and a second planar surface defining a cylinder body therebetween. The cylinder body has a central axis and a diameter, $d_3$, greater than the diameter $d_2$ of the second cylindrical portion of the eccentric wheel, and the first planar surface a is tilted to the second planar surface at an angle $\gamma$.

Each of the angles $\alpha$, $\beta$ and $\gamma$ is greater than zero but less than 90°, preferably, greater than zero but less than 45°. In one embodiment, $\beta=\alpha$, and $\gamma=\alpha$.

The massage bracket includes a first surface and an opposite, second surface defining a bracket body therebetween, a central axis and a plurality of stumps spaced-apart on the first surface, wherein the bracket body defines a first opening in the central region.

As assembled, the plurality of massage heads is attached to the plurality of stumps of the massage bracket, respectively. The second cylindrical portion of the eccentric wheel is received in the first opening of the massage bracket. The eccentric block is mounted to the second cylindrical portion of the eccentric wheel. Accordingly, the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel and the central axis of the massage bracket is substantially coincident with the central axis of the second cylinder portion of the eccentric wheel, and the massage bracket operably cooperates with the second cylindrical portion of the eccentric wheel.

In one embodiment, each massage member further includes a gear shaft having a first end portion and an opposite, second end portion. The gear shaft extends through the shield member of the carriage and is coaxially mounted to the corresponding second gear of the transmission assembly by the first end portion, while received in the shaft bore of the eccentric wheel by the second end portion.

Each massage member may also include means for limiting the massage bracket from rotating along the central axis of the first cylindrical portion of the eccentric wheel, where the limiting means comprises a U-shape fixture or a fixture bar mounted to the shield member of the carriage.

For a massage device under such arrangement, in operation, the motor drives the pair of the transmission shaft to rotate, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle $\alpha$, thereby causing the plurality of massage heads to move alternatively along a direction parallel to the central axis of the first cylindrical portion of the eccentric wheel so as to provide a massage effect to a user. The motion of each massage head has no rotation relative to the carriage about an axis that is generally perpendicular to both the longitudinal axis of the base cover and a transverse axis of the base cover.

In another aspect, the present invention relates to massage device includes a transmission assembly. In one embodiment, the transmission assembly includes:

(i) a motor having an output shaft;

(ii) a worm mechanically coupled with the output shaft of the motor;

(iii) a pair of first worm wheels meshing with the worm;

(iv) a pair of second worm wheels each meshing with a corresponding one of the pair of first worm wheels;

(v) a first gear coaxially mounted under one of the pair of second worm wheels;

(vi) a second gear meshing with the first gear;

(vii) a third gear meshing with the second gear; and (viii) a hoist transmission mechanism having a reel wheel coaxially mounted to the third gear, a pair of pulleys spatially mounted to a base cover, and a cable routed over the pair of pulleys and wound on the reel wheel, thereby defining a first distance, L1, between the reel wheel and one of the pair of pulleys, a second distance, L2, between the reel wheel and the other of the pair of pulleys, and a third distance, L3, between the pair of pulleys, such that when the reel wheel 147 rotates, it causes one of the first distance L1 and the second distance L2 to be decreased and the other of the first distance L1 and the second distance L2 to be increased, where $L1+L2=L\geqq L3$.

Under this arrangement, when the motor is activated, it drives the worm to rotate, the rotation of the worm results in, in turn, the rotations of the pair of first worm wheels, the pair of second worm wheels, the first gear, the second gear, the third gear, and the reel wheel, the rotation of the reel wheel causes one of the first distance L1 and the second distance L2 to be decreased and the other of the first distance L1 and the second distance L2 to be increased.

The massage device also includes a massage assembly having a plurality of massage heads, engaged with the transmission assembly such that the rotation of the pair of second worm wheels drives the plurality of massage heads to move in a predefined way so as to provide massage effects and the rotation of the reel wheel of the hoist transmission mechanism drives the massage assembly to translate between the pair of pulleys of the hoist transmission mechanism. But the massage assembly has no rotation as a whole.

Additionally, the massage device may include a base cover having a longitudinal axis and a plurality of guiding rails formed parallel to the longitudinal axis, and a carriage for receiving and securing the transmission assembly therein, having a chassis member and a shield member placed over the chassis member to form a chamber therebetween. The chassis member has a plurality of grooves formed such that when the carriage is engaged with the base cover, the plurality of guiding rails is received in the plurality of grooves of the chassis member, respectively, and the carriage is longitudinally movable back and forth along the plurality of guiding rails of the base cover.

In one embodiment, the massage assembly has a pair of massage members. Each massage member includes a driving member having an eccentric wheel and an eccentric block. The eccentric wheel has a first planar surface, a second planar surface tilted to the first planar surface at an angle $\beta$, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion, wherein the first cylindrical portion has a central axis substantially perpendicular to the first planar surface, and a diameter, d1, wherein the second cylindrical portion has a central axis substantially perpendicular to the second planar surface and defining an angle $\alpha$ relative to the central axis of the first cylindrical portion, and a diameter, d2, less than the diameter d1 of the first cylindrical portion, and wherein the shaft bore has a central axis that is substantially coincident with the central axis of the first cylindrical portion.

The eccentric block has a first planar surface and a second planar surface defining a cylinder body therebetween, wherein the cylinder body has a central axis and a diameter, d3, greater than the diameter d2 of the second cylindrical portion of the eccentric wheel, and the first planar surface is tilted to the second planar surface at an angle γ.

Each massage member includes also has a massage bracket having a first surface and an opposite, second surface defining a bracket body therebetween, a central axis and a plurality of stumps spaced-apart on the first surface, wherein the bracket body defines an opening therethrough in the central region, As assembled, the plurality of massage heads is attached to the plurality of stumps of the massage bracket, respectively, the second cylindrical portion of the eccentric wheel is received in the opening of the massage bracket; the eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel, the central axis of the massage bracket is substantially coincident with the central axis of the second cylinder portion of the eccentric wheel, and the massage bracket operably cooperates with the second cylindrical portion of the eccentric wheel.

Additionally, each massage member may further have a gear shaft having a first end portion and an opposite, second end portion. The gear shaft extends through the shield member of the carriage and is coaxially mounted to the corresponding second gear of the transmission assembly by the first end portion, while received in the shaft bore of the eccentric wheel by the second end portion.

In one embodiment, each massage member also has means for limiting the massage bracket from rotating along the central axis of the first cylindrical portion of the eccentric wheel, where the limiting means comprises a U-shape fixture or a fixture bar mounted to the shield member of the carriage.

For such a massage device, in operation, the motor drives the pair of the transmission shaft to rotate, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle α, thereby causing the plurality of massage heads to move alternatively along a direction parallel to the central axis of the first cylindrical portion of the eccentric wheel so as to provide a massage effect to a user. The motion of each massage head has no rotation relative to the carriage about an axis that is generally perpendicular to both the longitudinal axis of the base cover and a transverse axis of the base cover.

In yet another aspect, the present invention relates to a transmission assembly usable for a massage device. In one embodiment, the transmission assembly includes a motor having an output shaft, a worm mechanically coupled with the output shaft of the motor, a pair of first worm wheels meshing with the worm, a pair of second worm wheels each meshing with a corresponding one of the pair of first worm wheels, a first gear coaxially mounted under one of the pair of second worm wheels, a second gear meshing with the first gear, and a third gear meshing with the second gear.

Furthermore, the transmission assembly has a hoist transmission mechanism. The hoist transmission mechanism has a reel wheel coaxially mounted to the third gear, a pair of pulleys spatially mounted to a base cover, and a cable routed over the pair of pulleys and wound on the reel wheel, thereby defining a first distance, L1, between the reel wheel and one of the pair of pulleys, a second distance, L2, between the reel wheel and the other of the pair of pulleys, and a third distance, L3, between the pair of pulleys, such that when the reel wheel rotates, it causes one of the first distance L1 and the second distance L2 to be decreased and the other of the first distance L1 and the second distance L2 to be increased, where $L1+L2=L \geqq L3$.

Under this arrangement, when the motor is activated, it drives the worm to rotate, the rotation of the worm results in, in turn, the rotations of the pair of first worm wheels, the pair of second worm wheels, the first gear, the second gear, the third gear, and the reel wheel, the rotation of the reel wheel causes one of the first distance L1 and the second distance L2 to be decreased and the other of the first distance L1 and the second distance L2 to be increased.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
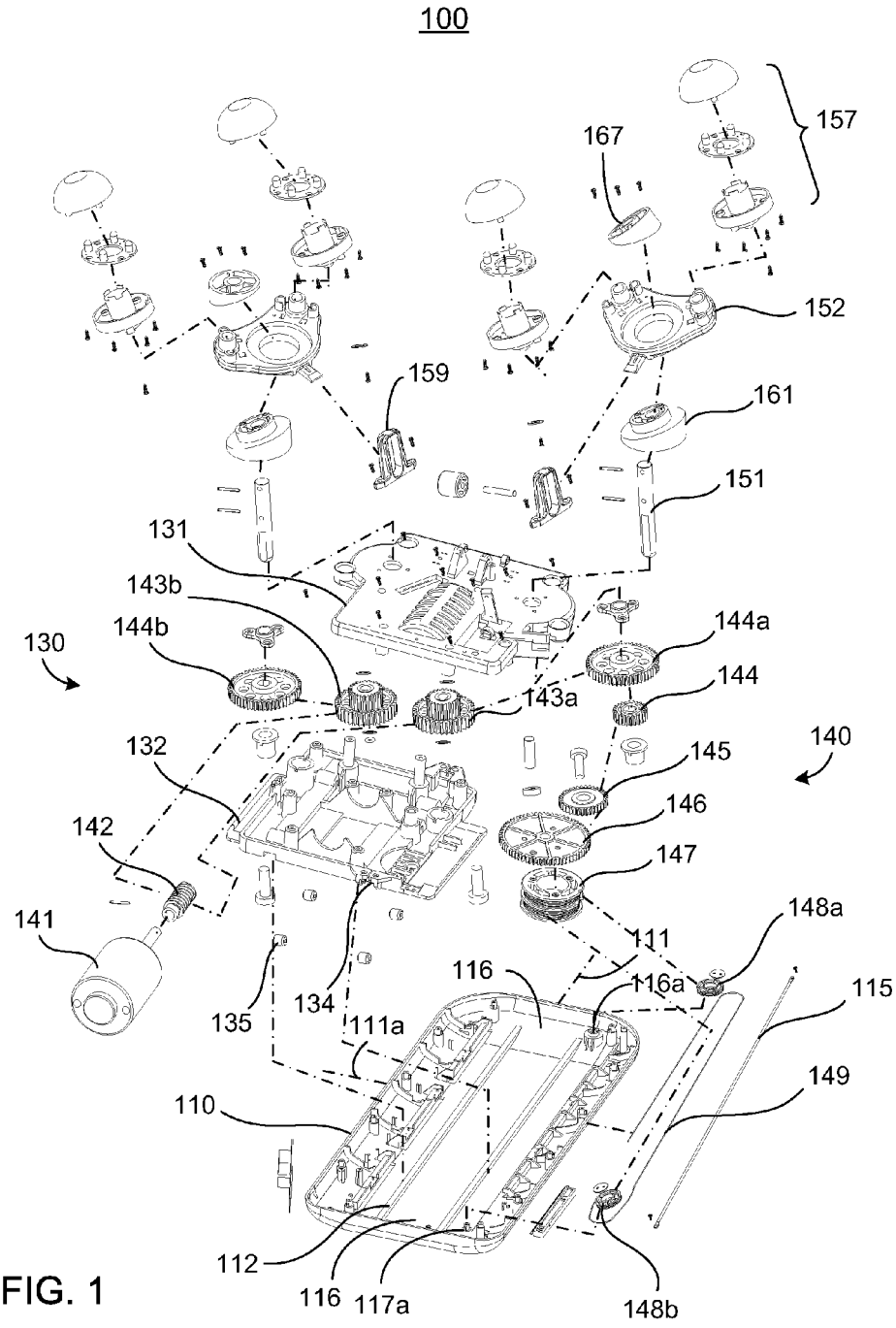
FIG. 1 shows an exploded view of a massage device according to one embodiment of the present invention.
Figure 2:
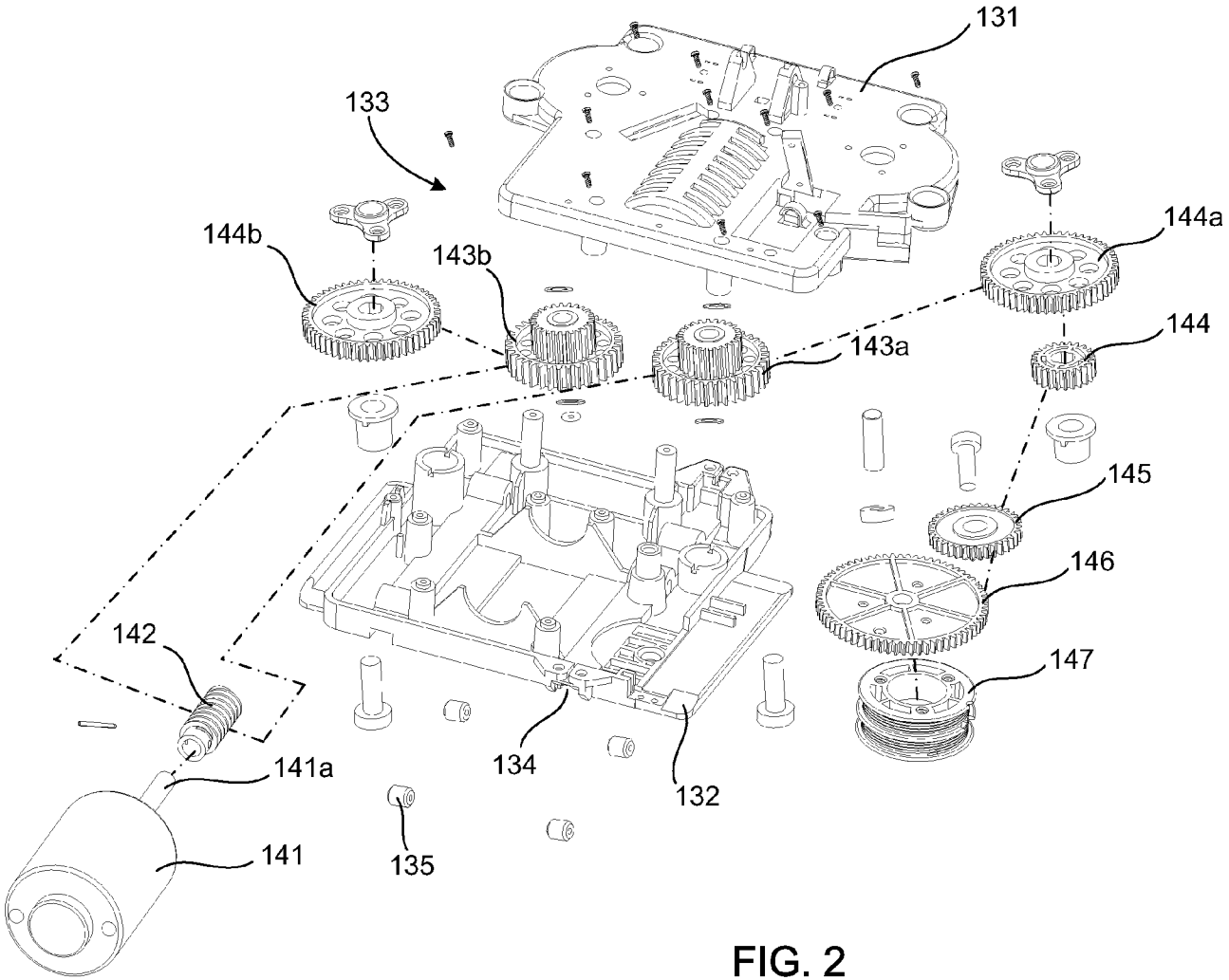
FIG. 2 shows a partially exploded view of the massage device as shown in FIG. 1.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Additionally, some terms used in this specification are more specifically defined below.

The description will be made as to the embodiments of the present invention in conjunction with the accompanying drawings in FIGS. 1-6. In accordance with the purposes of this invention, as embodied and broadly described herein, this invention, in one aspect, relates to a massage device that utilizes a gyro mechanism and a hoist transmission mechanism to provide massaging effects.

Referring first to FIGS. 1-5, a massage device 100 is shown according to one embodiment of the present invention. The massage device 100 includes a base cover 110, a carriage 130, a transmission assembly 140 and a massage assembly having a pair of massage members 150.

The base cover 110 has a longitudinal axis 111 and two guiding rails 112 formed parallel to the longitudinal axis 111. The two guiding rails 112 are adapted for cooperating with the carriage 130 and translating the pair of massage members 150 along the longitudinal axis 111. Other numbers of guiding rails can also be utilized to practice the present invention. The base cover 110 may also have a series of ribs 113 and supporting structures 114 for supporting and securing a top cover 118 to form a housing for accommodating the carriage 130, the transmission assembly 140 and the massage assembly therein. An additional supporting bar 115, which is mounted to the base cover 110, may also be used to practice the present invention. The base cover 110 is made of a durable material, such as wood, plastic, alloy or the like.

The carriage 130 includes a chassis member 131 and a shield member 132 placed over the chassis member 131 to form a chamber 133 therebetween. The chassis member 131 has two grooves 134 spaced-apart and formed on the bottom surface of the chassis member 131. The two grooves 134 are configured and sized to receive the two guiding rails 112 of the base cover 110, respectively. The cooperation of the guiding rails 112 of the base cover 110 and the grooves 134 of the chassis member 131 provides longitudinal guidance and support to the carriage 130 as it translates along the guiding rails 112. That is, when the carriage 130 is engaged with the base cover 110, the guiding rails 112 are respectively received in the grooves 134 of the chassis member 131 and the carriage 130 is longitudinally movable back and forth along the plurality of guiding rails 112 of the base cover 110. Other numbers of grooves can also be utilized to practice the present invention. The number of grooves is corresponding to the number of guiding rails formed in the base cover 110. Additionally, the carriage 130 may also include a plurality of roller bearings 135, each of which is pivotally connected to the carriage 130 and are offset from the grooves 134 and adjacent thereto for engaging a bearing surface provide upon each guiding rail 112. As the carriage 130 translates along the guiding rail 112, the carriage 130 is bearingly supported by the roller bearings 135 as they engage the surfaces provided by the guiding rails 112.

The transmission assembly 140 is received in the chamber 133 and secured in the carriage 130. The transmission assembly 140 has a motor 141 having an output shaft 141*a*, a worm 142 mechanically coupled with the output shaft 141*a* of the motor 141, a pair of first worm wheels 143*a* and 143*b* meshing with the worm 142, and a pair of second worm wheels 144*a* and 144*b* each meshing with a corresponding one of the pair of first worm wheels 143*a* and 143*b*.

The transmission assembly also has a first gear 144 coaxially mounted under one of the pair of second worm wheels 144*a* or 144*b*, a second gear 145 meshing with the first gear 144, and a third gear 146 meshing with the second gear 145.

Figure 3:
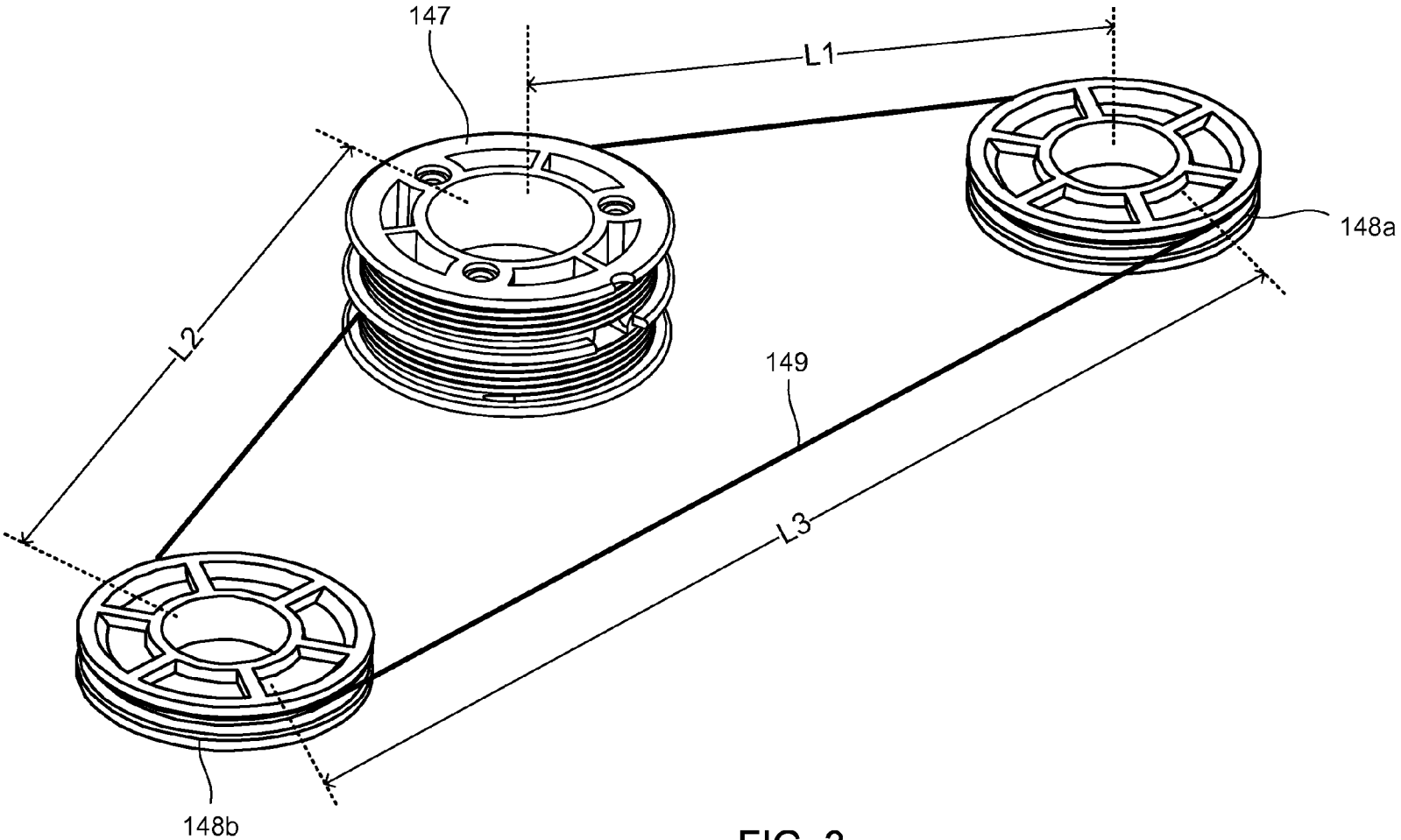
FIG. 3 shows a partially exploded view of a transmission assembly utilized in the massage device as shown in FIG. 1.
Figure 5:
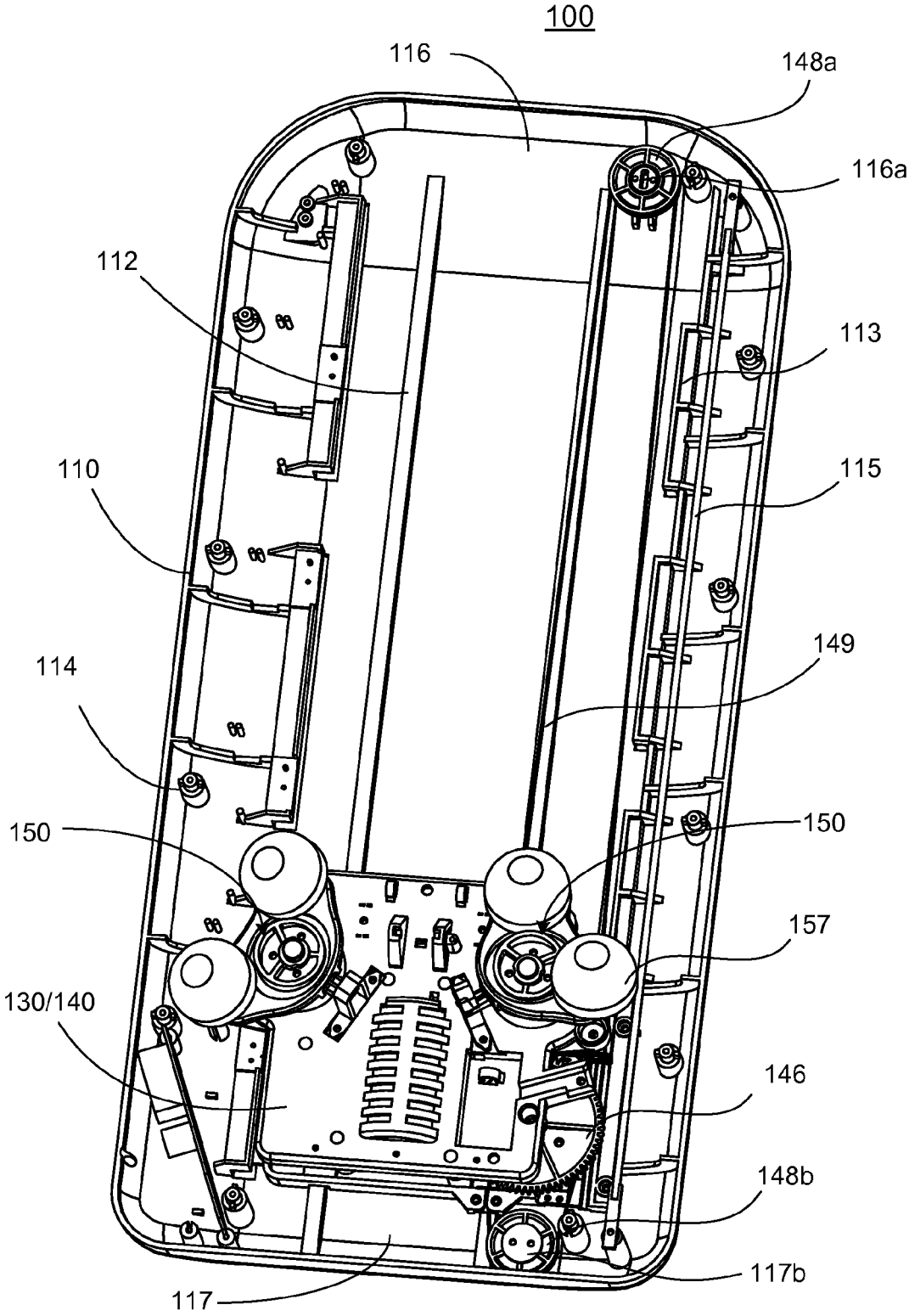
FIG. 5 shows a perspective view of the massage device as shown in FIG. 1.

Furthermore, the transmission assembly has a hoist transmission mechanism. As shown in FIGS. 1, 3 and 5, the hoist transmission mechanism has a reel wheel 147 coaxially mounted to the third gear 146 and positioned between the third gear 146 and the base cover 110, which makes the reel wheel 147 "unseen" behind the third gear 146, in FIG. 5, a pair of pulleys 148*a* and 148*b* respectively mounted to a mounting structure 116*a* of the first end portion 116 and a mounting structure 117*a* of the second portion 117 of the base cover 110, and a cable 149 routed over the pair of pulleys 148*a* and 148*b* and wound on the reel wheel 147, thereby defining a first distance, L1, between the reel wheel 147 and one of the pair of pulleys 148*a* and 148*b*, a second distance, L2, between the reel wheel 147 and the other of the pair of pulleys 148*a* and 148*b*, and a third distance, L3, between the pair of pulleys 148*a* and 148*b*. For such an arrangement, when the reel wheel 147 rotates, it causes one of the first distance L1 and the second distance L2 to be decreased and the other of the first distance L1 and the second distance L2 to be increased, where $L1+L2=L \geqq L3$. In one embodiment, the mounting structure 116*a* of the first end portion 116 and the mounting structure 117*a* of the second portion 117 of the base cover 110 define a direction that is parallel to the guiding rails 112.

For this transmission assembly 140, when the motor 141 is activated, it drives the worm 142 to rotate, the rotation of the worm 142 results in, in turn, the rotations of the pair of first worm wheels 143*a* and 143*b*, the pair of second worm wheels 144*a* and 144*b*, the first gear 144, the second gear 145, the third gear 146, and the reel wheel 147, the rotation of the reel wheel 147 causes one of the first distance L1 and the second distance L2 to be decreased and the other of the first distance L1 and the second distance L2 to be increased, thereby moving the carriage 130 along the plurality of the guiding rails of the base cover 110.

The massage assembly has a pair of massage members 150. Each massage member 150 has a gear shaft 151, a driving member 160, a massage bracket 152, two massage heads 157, and a limiting means such as a U-shape fixture or a fixture bar mounted to the shield member 132 of the carriage 130.

The gear shaft 151 has a first end portion 151 a and an opposite, second end portion 151*b*. The gear shaft 151 extends through the shield member 132 of the carriage 130 and is coaxially mounted to the corresponding second worm wheel 144*a* or 144*b* of the transmission shaft 140 by the first end portion 151*a*. In other words, when the second worm wheel 144*a* or 144*b* rotate, it drives the corresponding gear shaft 151 to rotate accordingly.

The massage bracket 152 includes a first surface 152*a* and an opposite, second surface 152*b* defining a bracket body 152*c* therebetween, a central axis 152*d*, a protrusion 155 laterally extending from the bracket body 152*c*, and two stumps 153 spaced-apart on the first surface 152*b*. The protrusion structure 155 is utilized, together with a limiting means such as a U-shape fixture mounted to the shield member 132 of the carriage 130, to limit the motion of the massage heads 157 in a predetermined way so as to provide desired massage effects. The bracket body 152*c* defines an opening 154 therethrough in the central region. Two massage heads 157 are respectively attached to two stumps 153 of the massage bracket 152. Other numbers of massage heads and stumps can also be utilized to practice the present invention.

Figure 4:
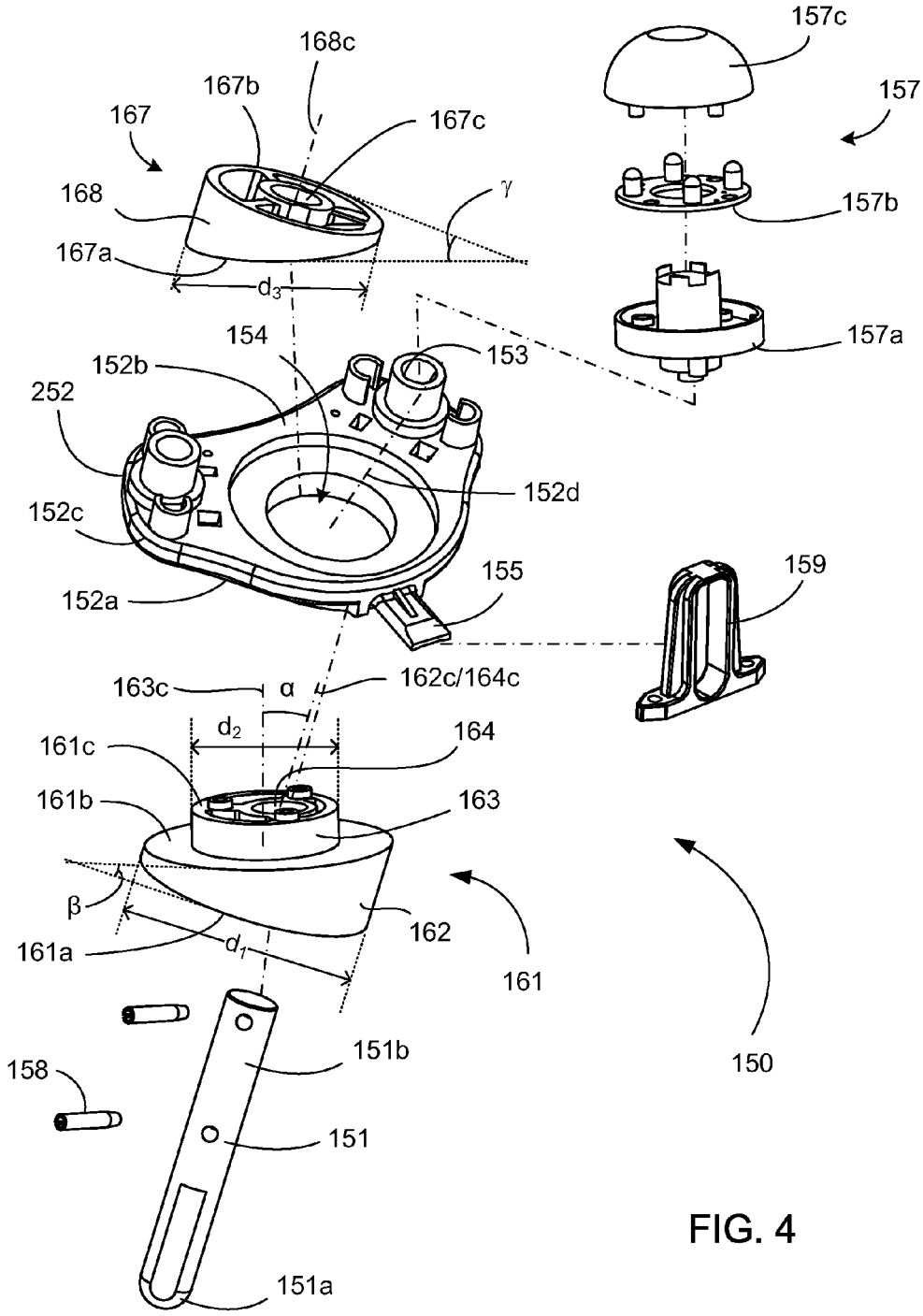
FIG. 4 shows a partially exploded view of a massage member utilized in the massage device as shown in FIG. 1.

In this embodiment as shown in FIG. 4, each massage head 157 has a mushroom-shape. Each massage head 157 has a first structure 157*a*, a mushroom-shape node 157*c* and a second structure 157*b* placed between the first structure 157*a* and the mushroom-shape node 157*c*. Each massage head 157 may include an energy source capable of generating thermal energy or photonic energy. The source energy may include a lamp base mounted to the corresponding one of the plurality of stumps 153, a PCB board attached to the lamp base, and heating lamps attached onto the PCB board. For example, the first structure 157*a* and the first structure 157*a* of a massage head 157 can be parts of the source energy.

The driving member 160 has an eccentric wheel 161 and an eccentric block 167. The eccentric wheel 161 has a first planar surface 161*a*, a second planar surface 161*b* tilted to the first planar surface 161*a* at an angle β, a third planar surface 161*c* parallel to the second planar surface 161*b*, a first cylindrical portion 162 defined between the first planar surface 161*a* and the second planar surface 161*b*, a second cylindrical portion 163 defined between the second planar surface 161*b* and the third planar surface 161*c*, and a shaft bore 164 defined through the first cylindrical portion 162 and the second cylindrical portion 163, where the first cylindrical portion 162 has a central axis 162*c* substantially perpendicular to the first planar surface 161*a*, and a diameter, $d_1$, where the second cylindrical portion 163 has a central axis 163*c* substantially perpendicular to the second planar surface 161*b* and defining an angle α, relative to the central axis 162*c* of the first cylindrical portion 162, and a diameter, $d_2$, less than the diameter $d_1$ of the first cylindrical portion 162. Each of the angles α and β is greater than zero but less than 90°, preferably, less than 45°. In one embodiment, β=α. The shaft bore 164 has a central axis 164*c* substantially coincident with the central axis 162*c* of the first cylindrical portion 162.

The eccentric block 167 has a first planar surface 167*a* and a second planar surface 167*b* defining a cylinder body 168 therebetween. The first planar surface 167*a* is tilted to the second planar surface 167*b* at an angle γ. The angle γ is greater than zero but less than 90°, preferably, less than 45°. In one embodiment, γ=α. Again, the angles α, β and γ can also be chosen with other values, same or different. The cylinder body 168 has a central axis 168*c* and a diameter, $d_3$, greater than the diameter $d_2$ of the second cylindrical portion 163 of the eccentric wheel 161. The eccentric block 167 may have a shaft bore 167*c* defined therethrough. The shaft bore 167*c* and the cylinder body 168 are substantially coaxial.

As assembled, the two massage heads 157 are respectively attached to the two stumps 153 of the massage bracket 152. The second cylindrical portion 163 of the eccentric wheel 161 is received in the first opening 154 of the massage bracket 152. The eccentric block 167 is then attached onto the second cylindrical portion 163 of the eccentric wheel 161 such that the first planar surface 167*a* of the eccentric block 167 is substantially in contact with and parallel to the third planar surface 161*c* of the eccentric wheel 161, the central axis 168*c* of the cylinder body 168 of the eccentric block 167 is substantially coincident with the central axis 162*c* of the first cylindrical portion 162 of the eccentric wheel 160, the central axis 152*d* of the massage bracket 152 is substantially coincident with the central axis 163*c* of the second cylinder portion 163 of the eccentric wheel 160, the massage bracket 152 operably cooperates with the second cylindrical portion 163 of the eccentric wheel 161, and the shaft bore 164 of the eccentric wheel 161 and the shaft bore 167*c* of the eccentric block 167 are substantially coaxial. Additionally, the protrusion 155 of the massage bracket 152 is received in the U-shape fixture 159 that in turn, is mounted to the shield member 132 of the carriage 130. The second end portion 151*b* of the gear shaft 151 is then secured into the shaft bore 164 such that when the gear shaft 151 rotates, it drives the driving member 160 to rotate accordingly. Additionally, fastening means such as fastening pins 158 and screws 158*a* may be applied wherever it is needed to secure various components of the massage device 100.

For the massage device 100, in operation, the motor 141 drives the transmission shaft 144 to rotate, which in turn, drives the carriage 130 to move along the plurality of the guiding rails 112 of the base cover 110 and the driving member 160 of the massage assembly 150 to rotate. Since the protrusion 155 of the massage bracket 152 is placed in the U-shape fixture 159 that is mounted to the shield member 134 of the carriage 130, the rotation of the massage bracket 152 around the central axis 162*c* of the first cylindrical portion 162 of the eccentric wheel 160 is prohibited. Therefore, the rotation of the driving member 160 of the massage assembly 150 will drive the massage bracket 152 to gyrate in a way so that its central axis 152*d* rotates around the central axis 162*c* of the first cylindrical portion 162 of the eccentric wheel 160 in the angle α. Such a gyro rotation of the massage bracket 152 causes the two massage heads 157 to move alternatively along a direction parallel to the central axis 162*c* of the first cylindrical portion 162 of the eccentric wheel 160. When the massage heads 157 are applied to parts of the body of a user, a simulated massaging effect is provided. According to the present invention, the motion of each massage head 157 has no rotation relative to the carriage 130 about an axis that is generally perpendicular to both the longitudinal axis 111 of the base cover 110 and a transverse axis 111*a* of the base cover 110, that is, each massage member 150, in operation, has no rotation relative to the carriage 130 as a whole because each massage member 150 is fixedly mounted through limiting means, such as a U-shape fixture disclosed above, to the shield member 132 of the carriage 130.

Figure 6:
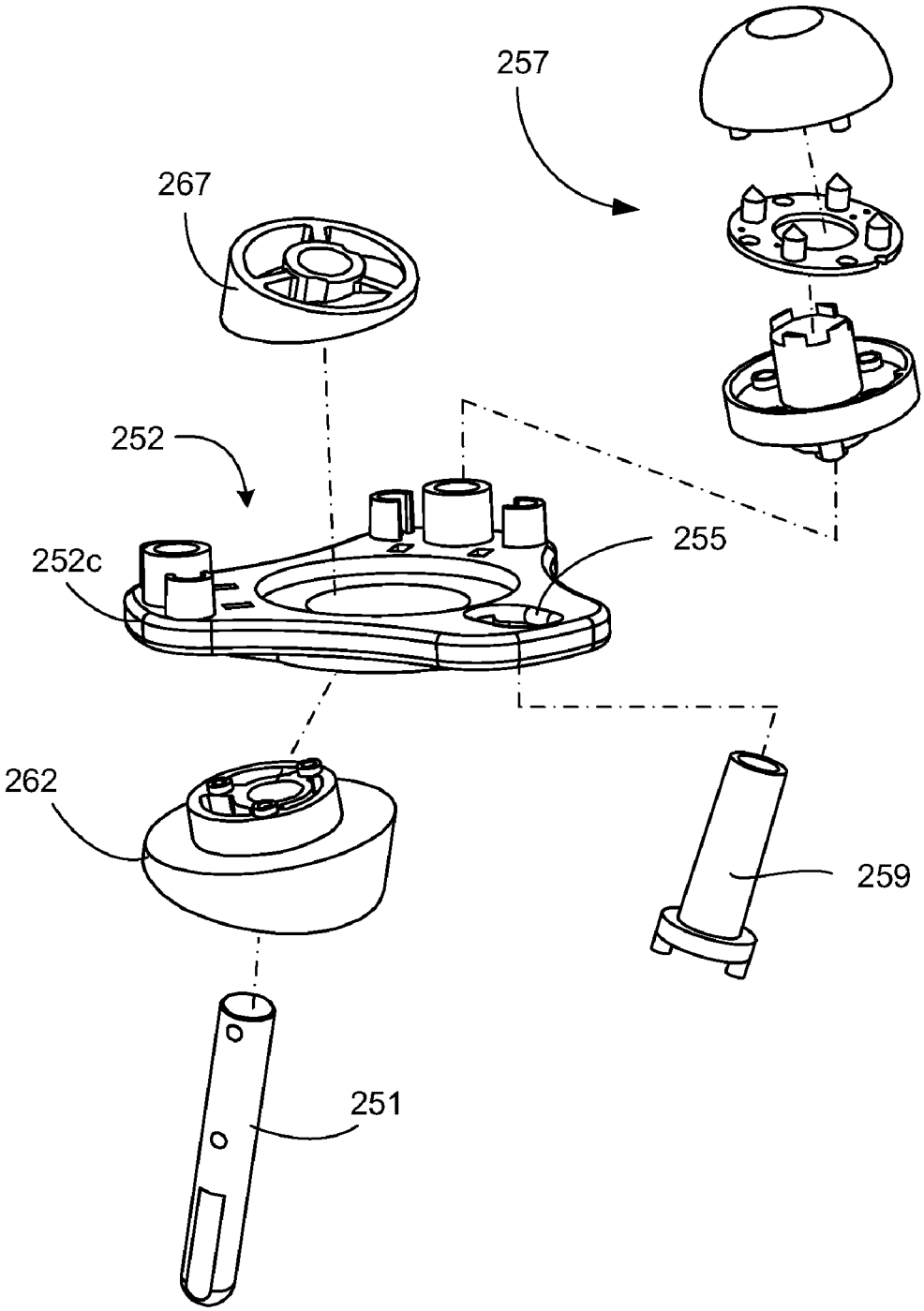
FIG. 6 shows a partially exploded view of a massage member utilized in the massage device according to one embodiment of the present invention.

FIG. 6 shows another embodiment of the massage member 250, which can also be utilized to practice the present invention. The massage member 250 has a gear shaft 251, a driving member 260, a massage bracket 252, two massage heads 257, and a limiting means. In this embodiment, the gear shaft 251, the driving member 260 and the massage heads 257 are identical to these shown in FIGS. 1 and 4. However, the massage bracket 252 has a second opening 255 formed on the edge portion of the bracket body, as shown in FIG. 6, instead of a protrusion extending from the bracket body. Accordingly, the limiting means includes of a fixture bar 259.

For such a massage device using the massage member 250, the arrangement of the transmission assembly and massage assembly is same as that shown in FIG. 1, except that the fixture bar 259 places into the second opening 255 of the massage bracket 252 and is mounted to the shield member of the carriage. Similarly, in operation, the rotation of the driving member of the massage assembly drives the massage bracket to gyrate in a way of which its central axis rotates along the central axis of the first cylindrical portion of the eccentric wheel in the angle α, thereby causing the plurality of massage heads to move alternatively along a direction parallel to the central axis of the first cylindrical portion of the eccentric wheel so as to provide a massage effect to a user.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A massage device, comprising:

(a) a base cover having a longitudinal axis and a plurality of guiding rails formed parallel to the longitudinal axis;

(b) a carriage having a chassis member and a shield member placed over the chassis member to form a chamber therebetween, wherein the chassis member has a plurality of grooves formed such that when the carriage is engaged with the base cover, the plurality of guiding rails is received in the plurality of grooves of the chassis member, respectively, and the carriage is longitudinally movable back and forth along the plurality of guiding rails of the base cover;

(c) a transmission assembly received in the chamber and secured in the carriage, having:

(i) a motor having an output shaft;

(ii) a worm mechanically coupled with the output shaft of the motor;

(iii) a pair of first worm wheels meshing with the worm;

(iv) a pair of second worm wheels each meshing with a corresponding one of the pair of first worm wheels;

(v) a first gear coaxially mounted under one of the pair of second worm wheels;

(vi) a second gear meshing with the first gear;

(vii) a third gear meshing with the second gear; and (viii) a hoist transmission mechanism having a reel wheel coaxially mounted to the third gear, a pair of pulleys respectively mounted to the first end portion and the second portion of the base cover, and a cable routed over the pair of pulleys and wound on the reel wheel, thereby defining a first distance, L1, between the reel wheel and one of the pair of pulleys, a second distance, L2, between the reel wheel and the other of the pair of pulleys, and a third distance, L3, between the pair of pulleys, such that when the reel wheel rotates, it causes one of the first distance L1 and the second distance L2 to be decreased and the other of the first distance L1 and the second distance L2 to be increased, wherein $L1+L2=L\geqq L3$, wherein when the motor is activated, it drives the worm to rotate, the rotation of the worm results in, in turn, the rotations of the pair of first worm wheels, the pair of second worm wheels, the first gear, the second gear, the third gear, and the reel wheel, the rotation of the reel wheel causes one of the first distance L1 and the second distance L2 to be decreased and the other of the first distance L1 and the second distance L2 to be increased, thereby moving the carriage along the plurality of the guiding rails of the base cover; and (d) a massage assembly having a pair of massage members, each massage member comprising:

(i) a driving member having an eccentric wheel and an eccentric block, wherein the eccentric wheel has a first planar surface, a second planar surface tilted to the first planar surface at an angle $\beta$, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion, wherein the first cylindrical portion has a central axis substantially perpendicular to the first planar surface, and a diameter, $d_1$, wherein the second cylindrical portion has a central axis substantially perpendicular to the second planar surface and defining an angle $\alpha$, relative to the central axis of the first cylindrical portion, and a diameter, $d_2$, less than the diameter $d_1$ of the first cylindrical portion, and wherein the shaft bore has a central axis that is substantially coincident with the central axis of the first cylindrical portion; and wherein the eccentric block has a first planar surface and a second planar surface defining a cylinder body therebetween, wherein the cylinder body has a central axis and a diameter, $d_3$, greater than the diameter $d_2$ of the second cylindrical portion of the eccentric wheel, and the first planar surface is tilted to the second planar surface at an angle $\gamma$;

(ii) a massage bracket having a first surface and an opposite, second surface defining a bracket body therebetween, a central axis and a plurality of stumps spaced-apart on the first surface, wherein the bracket body defines a first opening in the central region; and (iii) a plurality of massage heads, wherein as assembled, the plurality of massage heads is attached to the plurality of stumps of the massage bracket, respectively, the second cylindrical portion of the eccentric wheel is received in the first opening of the massage bracket, the eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel and the central axis of the massage bracket is substantially coincident with the central axis of the second cylinder portion of the eccentric wheel, and the massage bracket operably cooperates with the second cylindrical portion of the eccentric wheel, and wherein in operation, the motor drives the pair of first worm wheels to rotate, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle $\alpha$, thereby causing the plurality of massage heads to move alternatively along a direction parallel to the central axis of the first cylindrical portion of the eccentric wheel so as to provide a massage effect to a user, and wherein the motion of each massage head has no rotation relative to the carriage about an axis that is generally perpendicular to both the longitudinal axis of the base cover and a transverse axis of the base cover.

2. The massage device of claim 1, wherein each massage member further comprises a gear shaft having a first end portion and an opposite, second end portion, wherein the gear shaft extends through the shield member of the carriage and is coaxially mounted to the corresponding second worm wheel of the transmission assembly by the first end portion, while received in the shaft bore of the eccentric wheel by the second end portion.

3. The massage device of claim 2, wherein each massage member further comprises means for limiting the massage bracket from rotating along the central axis of the first cylindrical portion of the eccentric wheel.

4. The massage device of claim 3, wherein the limiting means comprises a U-shape fixture or a fixture bar mounted to the shield member of the carriage.

5. The massage device of claim 1, wherein each of the angles $\alpha$, $\beta$ and $\gamma$ is greater than zero but less than 90°.

6. The massage device of claim 5, wherein $\beta=\alpha$, and $\gamma=\alpha$.

7. The massage device of claim 1, wherein each of the plurality of massage heads has a mushroom-shape.

8. The massage device of claim 7, wherein each of the plurality of massage heads comprises a first structure, a mushroom-shape node and a second structure placed between the first structure and the mushroom-shape node.

9. The massage device of claim 1, wherein each of the plurality of massage heads comprises an energy source of capable of generating at least one of thermal energy and photonic energy.

10. The massage device of claim 9, wherein the source energy comprises a lamp base mounted to the corresponding one of the plurality of stumps, a PCB board attached to the lamp base, and heating lamps attached onto the PCB board.

11. A massage device, comprising:

(a) a transmission assembly having:

(i) a motor having an output shaft;

(ii) a worm mechanically coupled with the output shaft of the motor;

(iii) a pair of first worm wheels meshing with the worm;

(iv) a pair of second worm wheels each meshing with a corresponding one of the pair of first worm wheels;

(v) a first gear coaxially mounted under one of the pair of second worm wheels;

(vi) a second gear meshing with the first gear;

(vii) a third gear meshing with the second gear; and (viii) a hoist transmission mechanism having a reel wheel coaxially mounted to the third gear, a pair of pulleys spatially mounted to a base cover, and a cable routed over the pair of pulleys and wound on the reel wheel, thereby defining a first distance, L1, between the reel wheel and one of the pair of pulleys, a second distance, L2, between the reel wheel and the other of the pair of pulleys, and a third distance, L3, between the pair of pulleys, such that when the reel wheel rotates, it causes one of the first distance L1 and the second distance L2 to be decreased and the other of the first distance L1 and the second distance L2 to be increased, wherein $L1+L2=L\geqq L3$, wherein when the motor is activated, it drives the worm to rotate, the rotation of the worm results in, in turn, the rotations of the pair of first worm wheels, the pair of second worm wheels, the first gear, the second gear, the third gear, and the reel wheel, the rotation of the reel wheel causes one of the first distance L1 and the second distance L2 to be decreased and the other of the first distance L1 and the second distance L2 to be increased; and (b) a massage assembly having a plurality of massage heads, engaged with the transmission assembly such that the rotation of the pair of second worm wheels drives the plurality of massage heads to move in a predefined way so as to provide massage effects, and the rotation of the reel wheel of the hoist transmission mechanism drives the massage assembly to translate between the pair of pulleys of the hoist transmission mechanism but have no rotation as a whole.

12. The massage device of claim 11, further comprising:

(a) a base cover having a longitudinal axis and a plurality of guiding rails formed parallel to the longitudinal axis; and (b) a carriage for receiving and securing the transmission assembly therein, having a chassis member and a shield member placed over the chassis member to form a chamber therebetween, wherein the chassis member has a plurality of grooves formed such that when the carriage is engaged with the base cover, the plurality of guiding rails is received in the plurality of grooves of the chassis member, respectively, and the carriage is longitudinally movable back and forth along the plurality of guiding rails of the base cover.

13. The massage device of claim 12, wherein the massage assembly has a pair of massage members, each massage member comprising:

(a) a driving member having an eccentric wheel and an eccentric block, wherein the eccentric wheel has a first planar surface, a second planar surface tilted to the first planar surface at an angle $\beta$, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion, wherein the first cylindrical portion has a central axis substantially perpendicular to the first planar surface, and a diameter, d1, wherein the second cylindrical portion has a central axis substantially perpendicular to the second planar surface and defining an angle $\alpha$ relative to the central axis of the first cylindrical portion, and a diameter, d2, less than the diameter d1 of the first cylindrical portion, and wherein the shaft bore has a central axis that is substantially coincident with the central axis of the first cylindrical portion; and wherein the eccentric block has a first planar surface and a second planar surface defining a cylinder body therebetween, wherein the cylinder body has a central axis and a diameter, d3, greater than the diameter d2 of the second cylindrical portion of the eccentric wheel, and the first planar surface is tilted to the second planar surface at an angle $\gamma$; and (b) a massage bracket having a first surface and an opposite, second surface defining a bracket body therebetween, a central axis and a plurality of stumps spaced-apart on the first surface, wherein the bracket body defines an opening therethrough in the central region, wherein as assembled, the plurality of massage heads is attached to the plurality of stumps of the massage bracket, respectively, the second cylindrical portion of the eccentric wheel is received in the opening of the massage bracket; the eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel, the central axis of the massage bracket is substantially coincident with the central axis of the second cylinder portion of the eccentric wheel, and the massage bracket operably cooperates with the second cylindrical portion of the eccentric wheel.

14. The massage device of claim 13, wherein each massage member further comprises a gear shaft having a first end portion and an opposite, second end portion, wherein the gear shaft extends through the shield member of the carriage and is coaxially mounted to the corresponding second worm wheel of the transmission assembly by the first end portion, while received in the shaft bore of the eccentric wheel by the second end portion.

15. The massage device of claim 14, wherein each massage member further comprises means for limiting the massage bracket from rotating along the central axis of the first cylindrical portion of the eccentric wheel.

16. The massage device of claim 15, wherein the limiting means comprises a U-shape fixture or a fixture bar mounted to the shield member of the carriage.

17. The massage device of claim 16, wherein in operation, the motor drives the pair of first worm wheels to rotate, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle $\alpha$, thereby causing the plurality of massage heads to move alternatively along a direction parallel to the central axis of the first cylindrical portion of the eccentric wheel so as to provide a massage effect to a user, and wherein the motion of each massage head has no rotation relative the carriage about an axis that is generally perpendicular to both the longitudinal axis of the base cover and a transverse axis of the base cover.

18. The massage device of claim 12, wherein each of the plurality of massage heads comprises an energy source of capable of generating at least one of thermal energy and photonic energy.

19. A transmission assembly usable for a massage device, comprising:

(a) a motor having an output shaft;

(b) a worm mechanically coupled with the output shaft of the motor;

(c) a pair of first worm wheels meshing with the worm;

(d) a pair of second worm wheels each meshing with a corresponding one of the pair of first worm wheels;

(e) a first gear coaxially mounted under one of the pair of second worm wheels;

(f) a second gear meshing with the first gear;

(g) a third gear meshing with the second gear; and (h) a hoist transmission mechanism having a reel wheel coaxially mounted to the third gear, a pair of pulleys spatially mounted to a base cover, and a cable routed over the pair of pulleys and wound on the reel wheel, thereby defining a first distance, L1, between the reel wheel and one of the pair of pulleys, a second distance, L2, between the reel wheel and the other of the pair of pulleys, and a third distance, L3, between the pair of pulleys, such that when the reel wheel rotates, it causes one of the first distance L1 and the second distance L2 to be decreased and the other of the first distance L1 and the second distance L2 to be increased, wherein $L1+L2=L \geqq L3$, wherein when the motor is activated, it drives the worm to rotate, the rotation of the worm results in, in turn, the rotations of the pair of first worm wheels, the pair of second worm wheels, the first gear, the second gear, the third gear, and the reel wheel, the rotation of the reel wheel causes one of the first distance L1 and the second distance L2 to be decreased and the other of the first distance L1 and the second distance L2 to be increased.

* * * * *